US012788079B2

(12) United States Patent
Lazic

(10) Patent No.: US 12,788,079 B2
(45) Date of Patent: Nov. 10, 2026

(54) WAISTBAND FOR GARMENTS

(71) Applicant: LULULEMON ATHLETICA CANADA INC., Vancouver (CA)

(72) Inventor: Natasa Lazic, Vancouver (CA)

(73) Assignee: Lululemon Athletica Canada Inc., Vancouver (CA)

( * ) Notice: Subject to any disclaimer, the term of this patent is extended or adjusted under 35 U.S.C. 154(b) by 25 days.

(21) Appl. No.: 18/309,067

(22) Filed: Apr. 28, 2023

(65) Prior Publication Data

US 2024/0358096 A1 Oct. 31, 2024

(51) Int. Cl.
*A41D 1/06* (2006.01)
*A41D 1/14* (2006.01)

(52) U.S. Cl.
CPC ..... *A41D 1/06* (2013.01); *A41D 1/14* (2013.01)

(58) Field of Classification Search
CPC ... A41D 1/06; A41D 1/08; A41D 1/14; A41D 2400/38; A41D 2500/10; A41D 9/14; A41B 9/14; A41F 9/00; A41F 9/002; A41F 9/005; A41F 9/007; A41F 9/02; A41F 9/025
See application file for complete search history.

(56) References Cited

U.S. PATENT DOCUMENTS

| | | | | | |
|---|---|---|---|---|---|
| 5,255,393 | A * | 10/1993 | Brady | A41B 9/14 | 450/131 |
| 5,367,708 | A * | 11/1994 | Fujimoto | A61F 13/06 | 2/22 |
| D750,346 | S * | 3/2016 | McManus | D2/742 | |
| 10,039,330 | B2 * | 8/2018 | Tanaka | A41D 1/088 | |
| 2005/0239370 | A1 * | 10/2005 | Oyama | A41C 1/003 | 450/99 |
| 2009/0025115 | A1 * | 1/2009 | Duffy | A41D 13/0015 | 2/243.1 |
| 2012/0129425 | A1 * | 5/2012 | Bevans | A41D 1/06 | 450/11 |
| 2018/0132544 | A1 * | 5/2018 | Albanese | A41D 1/08 | |
| 2018/0318142 | A1 * | 11/2018 | Gagliardo | A41F 9/00 | |
| 2018/0325189 | A1 * | 11/2018 | Stallbaum | A41D 1/08 | |
| 2019/0297972 | A1 * | 10/2019 | Holmes | A41F 9/025 | |
| 2021/0059864 | A1 * | 3/2021 | Reilly | A61F 13/08 | |
| 2021/0298396 | A1 * | 9/2021 | Lazic | A41F 9/00 | |

* cited by examiner

*Primary Examiner* — Haley A Smith
(74) *Attorney, Agent, or Firm* — Norton Rose Fulbright Canada LLP; Thomas Sutherland

(57) ABSTRACT

Waistbands and garments with waistbands are provided. The waistband has a front panel, a back panel and two side panels configured to connect the front panel and the back panel. When worn on a body, the front panel covers a portion of the body proximate to the front and waistline while the back panel covers a portion of the body proximate to the back and waistline. To provide the desired support, the two side panels provide an amount of compression greater than the front panel or back panel.

24 Claims, 16 Drawing Sheets

WAISTBAND FOR GARMENTS

FIELD

The present disclosure generally relates to the field of garments and in particular waistbands for garments.

BACKGROUND

Sport attires are specialized based on the type of sports the attire is intended for. In particular, sport attires are designed to be non-restrictive to a player's range of motion while providing adequate support, and to keep the player warm or cool and dry. Improved sport attires are needed having the desired function while maintaining aesthetically pleasing appearance.

SUMMARY

In one aspect, there is provided a waistband for a garment, comprising: a front panel configured when worn on a body to cover a portion of the body proximate to the front and waistline, the front panel having a upper edge, a lower edge and two side edges; a back panel configured when worn on a body to cover a portion of the body proximate to the back and waistline, the back panel having a upper edge, lower edge and two side edges; two side panels configured to connect the front panel and the back panel, each side panel having a upper edge, a lower edge, and two side edges; wherein the two side panels provide an amount of compression greater than the front panel or back panel.

In one embodiment, the front panel, back panel, and two side panels comprise one or more fabric layers. In one embedment, one or more panel is formed of one or more component panel to form the panel. In one embodiment, the side panels are constructed of a fabric with an amount of compression greater than the fabric of the front panel or back panel. In one embodiment, the side panels are constructed of a fabric with an amount of circumferential compression greater than the fabric of the front panel or back panel. In one embodiment, the front panel has a vertical top to bottom length that is less than a vertical top to bottom length of the back panel. In one embodiment, the front panel has a vertical top to bottom length that is less than 70% the back panel top to bottom length. In one embodiment, one or more of the two side panels are constructed of a thicker fabric than the front panel or back panel fabric. In one embodiment, one or more of the two side panels are constructed of a different fabric than the front panel or back panel. In one embodiment, the two side panels are constructed of one or more same fabric. In one embodiment, the front panel and back panel are constructed of one or more same fabric. In one embodiment, the side panels extend a greater vertical top to bottom length proximate the front panel and a lesser vertical top to bottom length proximate the back panel. In one embodiment, the waistband further comprises a elasticized accessory strap having a top edge and a bottom edge and attached to a side panel. In one embodiment, the elasticized accessory strap is attached to a side panel such that the bottom edge of the elasticized accessory strap is offset from the bottom edge of the front panel. In one embodiment, the back panel lower edge forms a substantially concave line. In one embodiment, the lower edge of one or more of the two side panels aligns with the substantially concave back panel lower edge to form an extended substantially concave line. In one embodiment, the two side panels provide an amount of compression greater than the front panel or back panel through the two side panels further comprises one or more of a fabric coating, an applied compression fabric, an applied compression mesh, an adhesive technique applied on a fabric surface, an adhesive technique applied between one or more fabric layer. In one embodiment, the garment is one of a short, pant, trouser, legging, skirt, skort, dress, swimsuit, bodysuit, romper, or jumpsuit.

In another aspect, there is provided a waistband for a bottom wear, comprising a front panel configured when worn on a body to cover a portion of the body proximate to the front and waistline; a back panel configured when worn on a body to cover a portion of the body proximate to the back and waistline; a first side panel configured to connect to a first side edge of the front panel and a first side of the back panel, and a second side panel configured to connect to a second side edge of the front panel and a second side of the back panel, thereby defining a circumference of the waistband; wherein the two side panels provide an amount of compression greater than the front panel or back panel.

In another aspect, there is provided a garment having the waistband as described herein. In one embodiment, the garment is a short, pant, trouser, legging, skirt, skort, dress, swimsuit, bodysuit, romper, or jumpsuit.

In another aspect, there is provided a bottom wear having the waistband as described herein. In one embodiment, the garment is a short, pant, trouser, legging, skirt, or skort.

In another aspect, a method for forming a waistband for a garment, the method comprising: providing a front panel, a back panel, and 2 side panels, wherein the two side panels provide an amount of compression greater than the front panel or back panel; and connecting the two side panels to the front panel and the back panel to form the waistband; wherein the front panel when worn on a body is configured to cover a portion of the body proximate to the front and waistline, and wherein the back panel when worn on a body is configured to cover a portion of the body proximate to the back and waistline. In one embodiment, the method further comprises attaching the waistband to a garment. In one embodiment, the garment is a short, pant, trouser, legging, skirt, skort, dress, swimsuit, bodysuit, romper, or jumpsuit.

In this respect, before explaining at least one embodiment in detail, it is to be understood that the embodiments are not limited in application to the details of construction and to the arrangements of the components set forth in the following description or illustrated in the drawings. Also, it is to be understood that the phraseology and terminology employed herein are for the purpose of description and should not be regarded as limiting.

Many further features and combinations thereof concerning embodiments described herein will appear to those skilled in the art following a reading of the instant disclosure.

DESCRIPTION OF THE FIGURES

Embodiments of the garments and waistbands are described throughout reference to the drawings.

DETAILED DESCRIPTION

Numerous details are set forth to provide an understanding of the examples described herein. The examples may be practiced without these details. The description is not to be considered as limited to the scope of the examples described herein.

The present disclosure provides for garments having a waistband comprised of multiple panels. The garments described herein allows for a finished look which are needed for some sport activities. The garments described herein provide appropriate business casual appearance, allowing for wearers to, for example, transition between daily activities with case. For example, golf courses have dress codes, hence appropriate garments are need that provide functionality while maintaining a finished look. In particular, a flat front and back are desirable to reduce the appearance of bulge (or "muffin top" effect), while flexibility of the side panel are needed to support the range of motion in the sport. Garments having targeted support, or imparting a supported sensation for the wearer, provide muscle support and improve comfort while taking part in the sport as well as wearer's performance.

Figure 1:
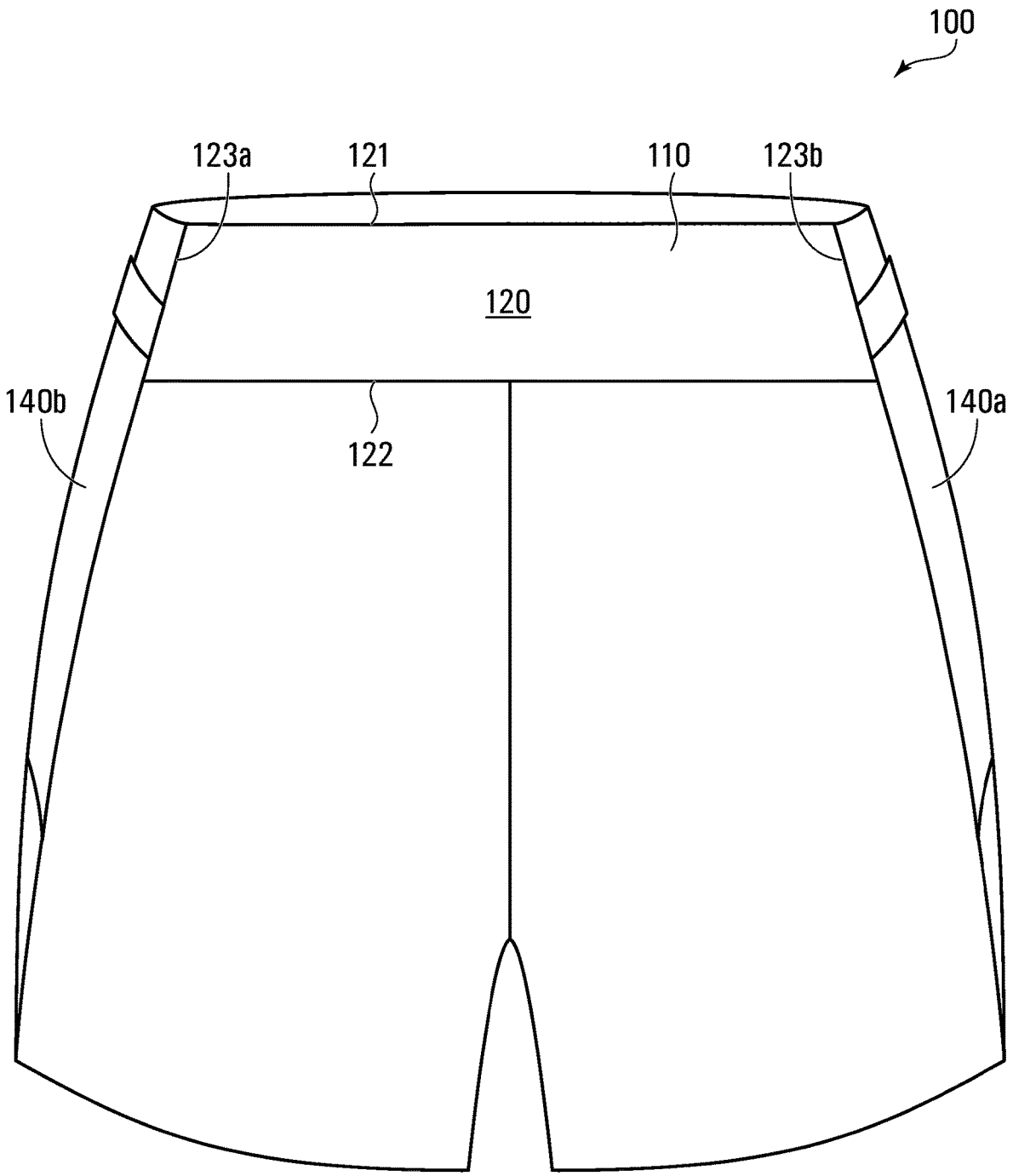
FIG. 1 shows a front view of a pair of shorts having a waistband.
Figure 2:
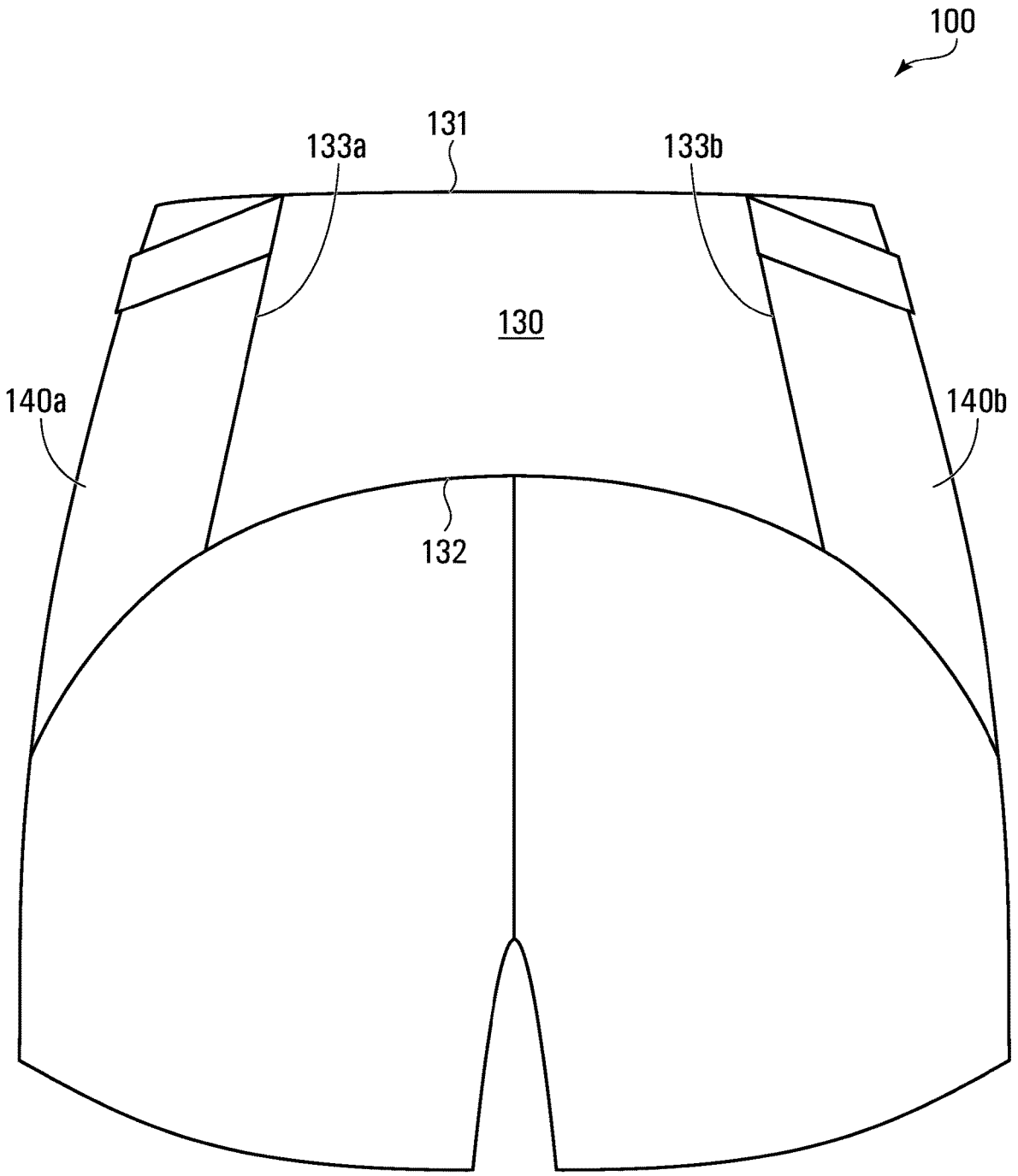
FIG. 2 is a rear side view of the shorts.
Figure 3:
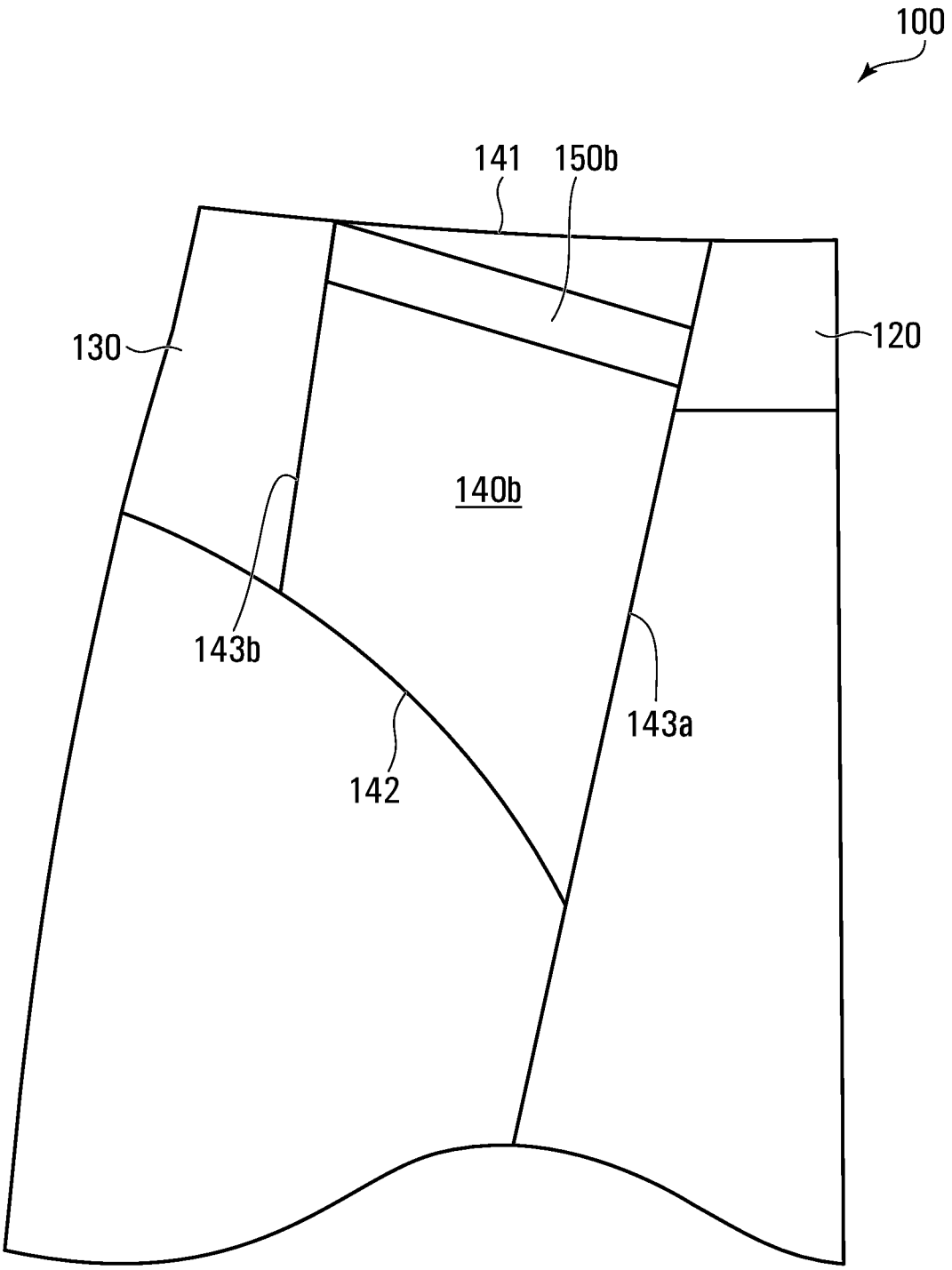
FIG. 3 is a left side view of the shorts.
Figure 4:
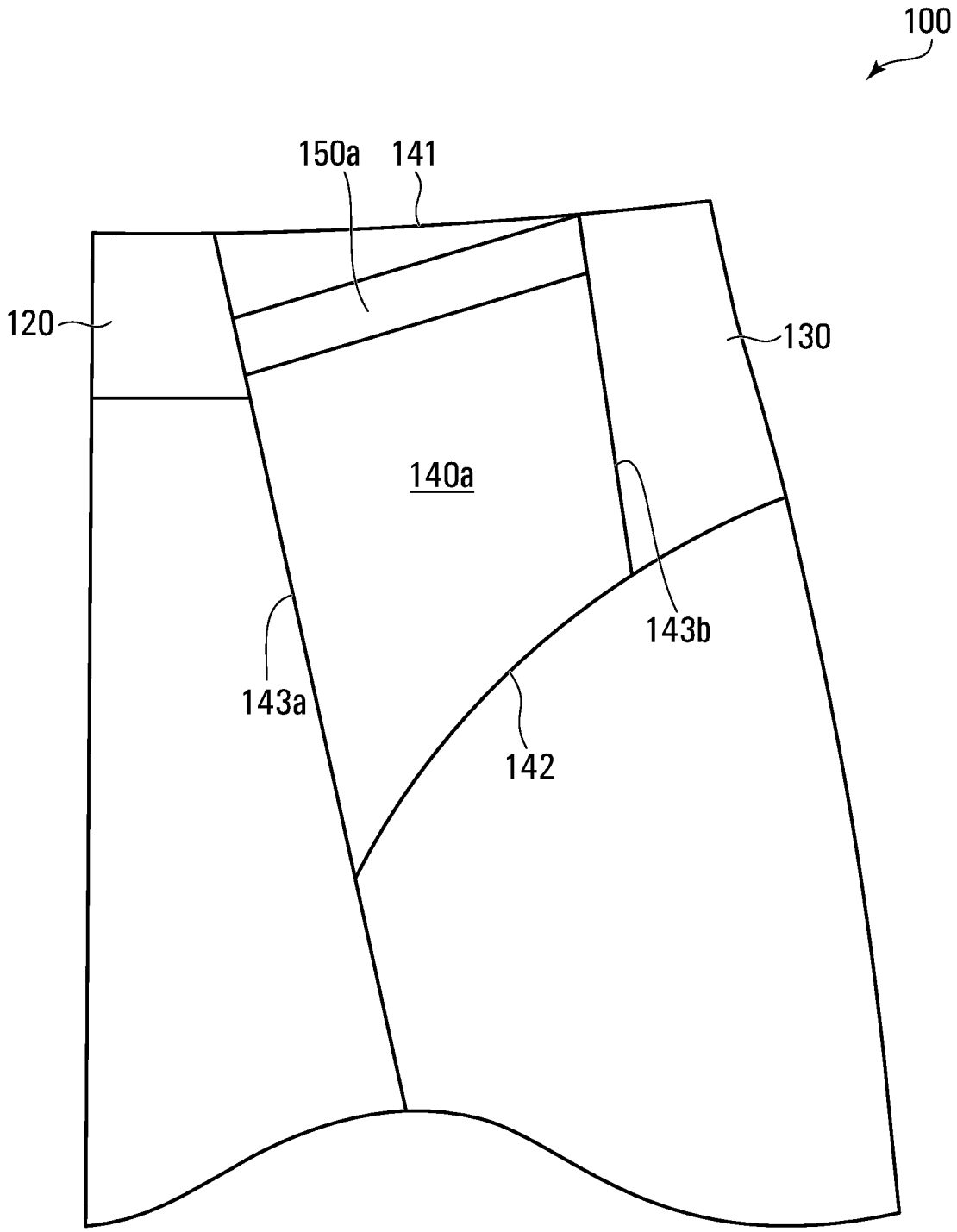
FIG. 4 is a right side view of the shorts.

Turning to FIGS. 1-4, an exemplary shorts 100 is provided having a waistband 110. The waistband 110 has a front panel 120, a back panel 130, and left and right side panels 140*a*, 140*b*. The front panel 120 is positioned to reduce the appearance of front or belly bulge of the wearer when wearing the shorts 100. In one embodiment, the front panel is configured to cover a portion of the body proximate to the front and waistline, when worn on a body. The front panel 120 has an upper edge 121, a lower edge 122, and two side edges 123*a*, 123*b*. The back panel 130 is positioned to reduce the appearance of back bulge of the wearer when wearing the shorts 100. In one embodiment, the back panel is configured to cover a portion of the body proximate to the back and waistline, when worn on a body. The back panel 130 has an upper edge 131, a lower edge 132, and two side edges 133*a*, 133*b*. The left and right side panels 140*a*, 140*b* each have an upper edge 141, a lower edge 142, and two side edges 143*a*, 143*b*. The left and right side panels are attached to the front panel at their respective side edges 123*a*, 123*b*, 143*a*, and are also attached to the back panel at their other respective side edges 133*a*, 133*b*, 143*b*. The shorts 100 has side panels 140*a*, 140*b* made from a different fabric (for example a thicker fabric and/or more compressive fabric) than the front and back panels 120, 130.

In some embodiments, the panels are made from a single piece of material. In some embodiments, the panels are made of one fabric layer. In other embodiments, the panels are made of multiple fabric layers. In some embodiments, the panels are formed from one component panel. In other embodiments, the panels are formed from multiple component panels. In some embodiments, some of the panels are formed from one component panel while the other panels are formed from multiple component panels.

In some embodiments, the side panels are constructed to provide a greater amount of compression pressure on the body than the fabric of the front and/or back panels. In some embodiments, the left and right side panels are constructed from one or more of the same fabric. In other embodiments, the left and right side panels are constructed from one or more different fabrics. In some embodiments, the front and back panels are constructed from one or more of the same fabric. In other embodiments, the front and back panels are constructed from one or more different fabrics.

In some embodiments, the side panels are constructed of compression fabric or mesh. As used herein, a "compression fabric or mesh" refers to elastic materials having the characteristics of extensibility and elastic recovery, and are able to exert continuous pressure (such as compression pressure) on the body when worn. In one embodiment, all the panels are constructed of compression fabric. In one embodiment, the side panels are constructed of a fabric that exhibits greater or more dynamic elastic recovery than the fabric of the front and/or back panels.

In one embodiment, the sides panels are made from a thicker or heavier fabric than that of the front and/or back panels. In one embodiment, the sides panels are made fabric such as Ultralu, nylon, Lycra™, a nylon/Lycra™ blend, and/or a knit fabric. In one embodiment, the front and/or back panels are made from a light weight material. In one embodiment, the front and/or back panels are made from polyester, a knit fabric, and/or a 4-way stretch fabric. In one embodiment, the front and/or back panels are made from a fabric having about 200 gsm, preferably 215 gsm.

In some embodiments, the side panels uses one or more techniques to provide a greater amount of compression pressure on the body than the fabric of the front and/or back panels. In some embodiments, the two side panels comprises one or more of a fabric coating, an applied compression fabric, an applied compression mesh, an adhesive technique applied on a fabric surface, an adhesive technique applied between one or more fabric layer. In some embodiments, one or more of construction techniques, coating techniques, and/or adhesive techniques are used to create side panels that provide a greater amount of compression pressure on the body than the fabric of the front and/or back panels. For example, construction techniques include but are not limited to using stitching patterns that allow for greater overall fabric extensibility, bias direction, rebound, and/or elastic recovery.

In some embodiments, to create the side panels the use of glue and/or adhesive techniques are applied such that the side panels provide a greater amount of compression pressure on the body than the fabric of the front and/or back panels. In some embodiments, adhesives include, but are not limited to, glue/adhesive polymers such as polyurethane, polyimide, epoxy, acrylic, polyamide, polyester, or protein, or combinations thereof.

In some embodiments, the side panel comprises an engineered support structure wherein an adhesive dots matrix pattern provides compression and support. In some embodiments, the dot matrix pattern comprises at least one first zone with a first level of support defined by a first adhesive dots density or first size of the adhesive dots and at least one second zone with a second level of support defined by a second adhesive dots density or second size of the adhesive dots in the adhesive dots matrix pattern, the first level of support being different from the second level of support. In some embodiments the dot matrix pattern is located in one or more of between two fabric layers that define a side panel, an inner surface of a side panel, an outer surface of a side panel, between one more additional side panel layers, for example, when a spacer fabric component is included in the construction of a side panel.

Returning to FIGS. 1-4, shorts 100 the front panel 120 has a vertical top to bottom length that is less than a vertical top to bottom length of the back panel 130. In some embodiments, the front panel has a vertical top to bottom length that is less than 70%, less than 65%, less than 60%, less than 50%, less than 40% of the back panel top to bottom length. In one embodiment, the front panel has a vertical top to bottom length that is about 62.5% of the back panel top to bottom length. The side edge 143*a* of the left and right side panels 140*a*, 140*b* that is proximate to the front panel 120 has greater vertical top to bottom length than side edge 143*b* of the left and right side panels that is proximate to the back panel 130. Hence, the lower edge 142 of the left and right side panels is angled or curved upward as it extends from side edge 143*a* to 143*b*. Lower edge 142 of the left and right side panels is continuous or aligned with the lower edge 132 of the back panel 130. In some embodiments, back panel lower edge forms a substantially concave line. In some embodiments, the lower edge of one or more of the two side panels aligns with the back panel lower edge to form an extended substantially concave line.

Shorts 100 also has optional accessory straps 150*a*, 150*b* designed to hold an item such as a towel, gloves, shirt, clasp, etc. In some embodiments, the accessory strap is made from an clastic material. The accessory straps each have a top edge 151 and a bottom edge 152. The top edge 151 of the accessory strap extends across the side panel to the upper edge 141 of the side panel adjacent to the back panel. The bottom edge 152 of the accessory strap is offset from the lower edge 122 of the front panel 120, and extends across the side panel. In some embodiments, the accessory strap is elasticized using one or more techniques described herein. In some embodiments, the accessory strap is attached to the side panel. In some embodiments, the accessory strap extends from one side edge of the side panel to the other side edge, and provide additional compression pressure on the body. In some embodiments, the bottom edge of the accessory strap is aligned with the lower edge of the front panel. In other embodiments, the bottom edge of the accessory strap is offset from the lower edge of the front panel. In one embodiment, the bottom edge of the accessory strap is offset above the lower edge of the front panel.

In some embodiments, the waistband further comprises one or more pockets. In some embodiments, a pocket opening may be formed at one or more side edge of front panel, or along lower edge of back panel and/or side panel where the waistband attaches to the garment. For example, shorts 100 can also have a pocket with the pocket opening formed at one or more side edge 123*a*, 123*b* of front panel 120, or along lower edge 132 of back panel 130 and/or along lower edge 142 of side panels 140*a*, 140*b* where the waistband 110 attaches to the rest of the shorts 110.

In some embodiments a functional, decorative, key, coin, or other pocket may be attached to one or more of front panel, back panel, or side panels on an outer or inner surface. Such a pocket may further comprise fasteners such as buttons, zippers, and/or flaps.

Figure 5:
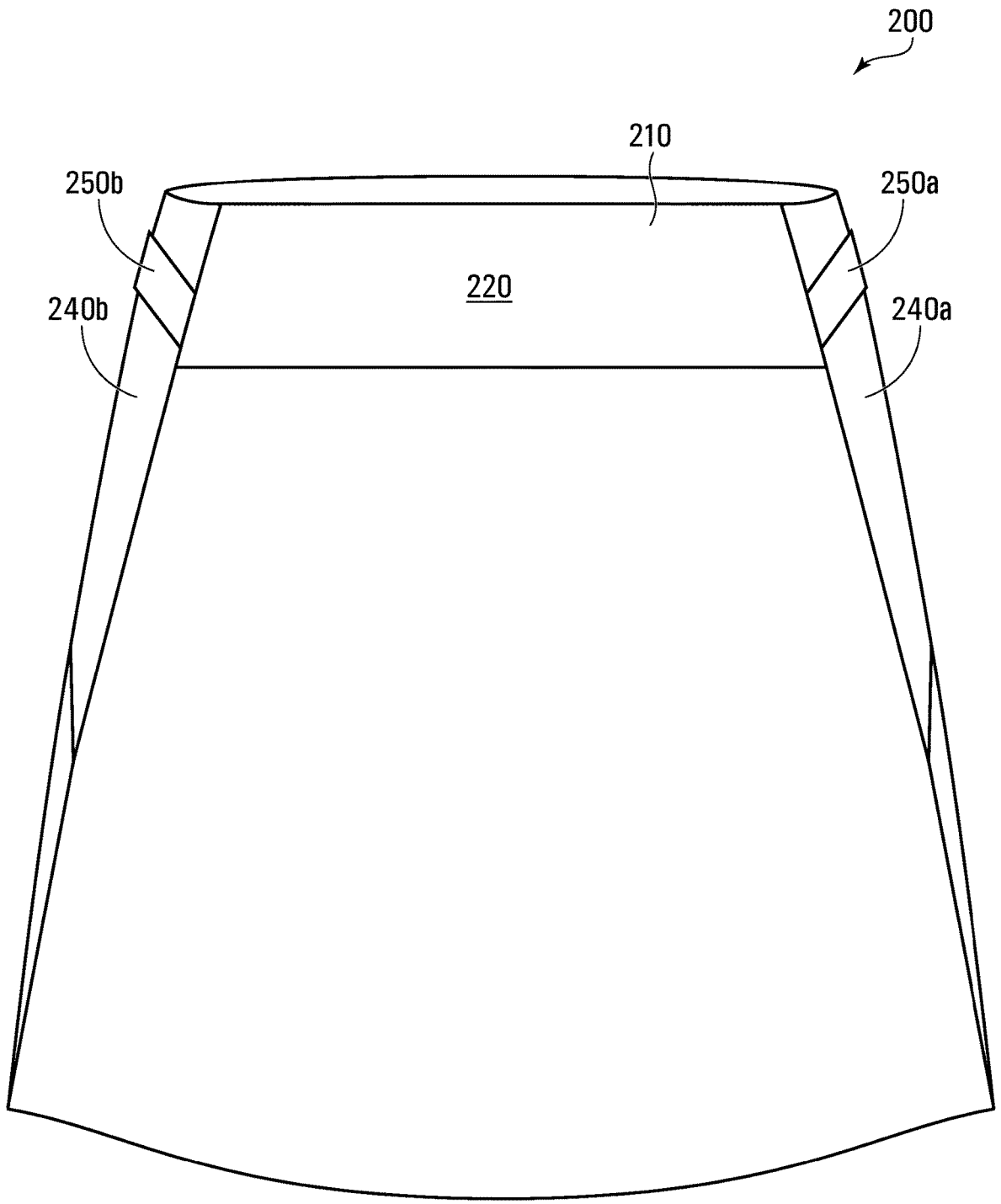
FIG. 5 shows a front view of a skirt having a waistband.
Figure 6:
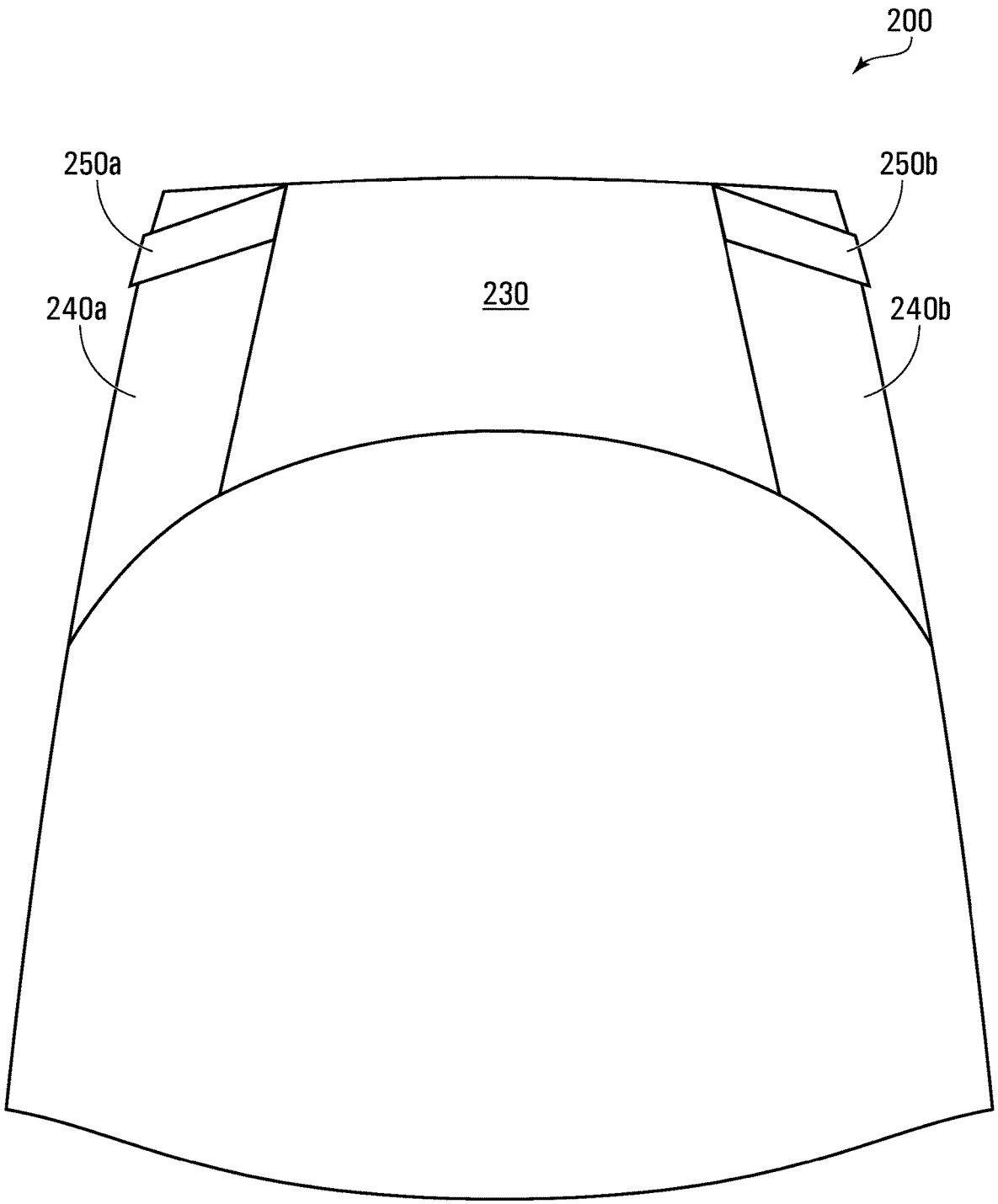
FIG. 6 is a rear side view of the skirt.
Figure 7:
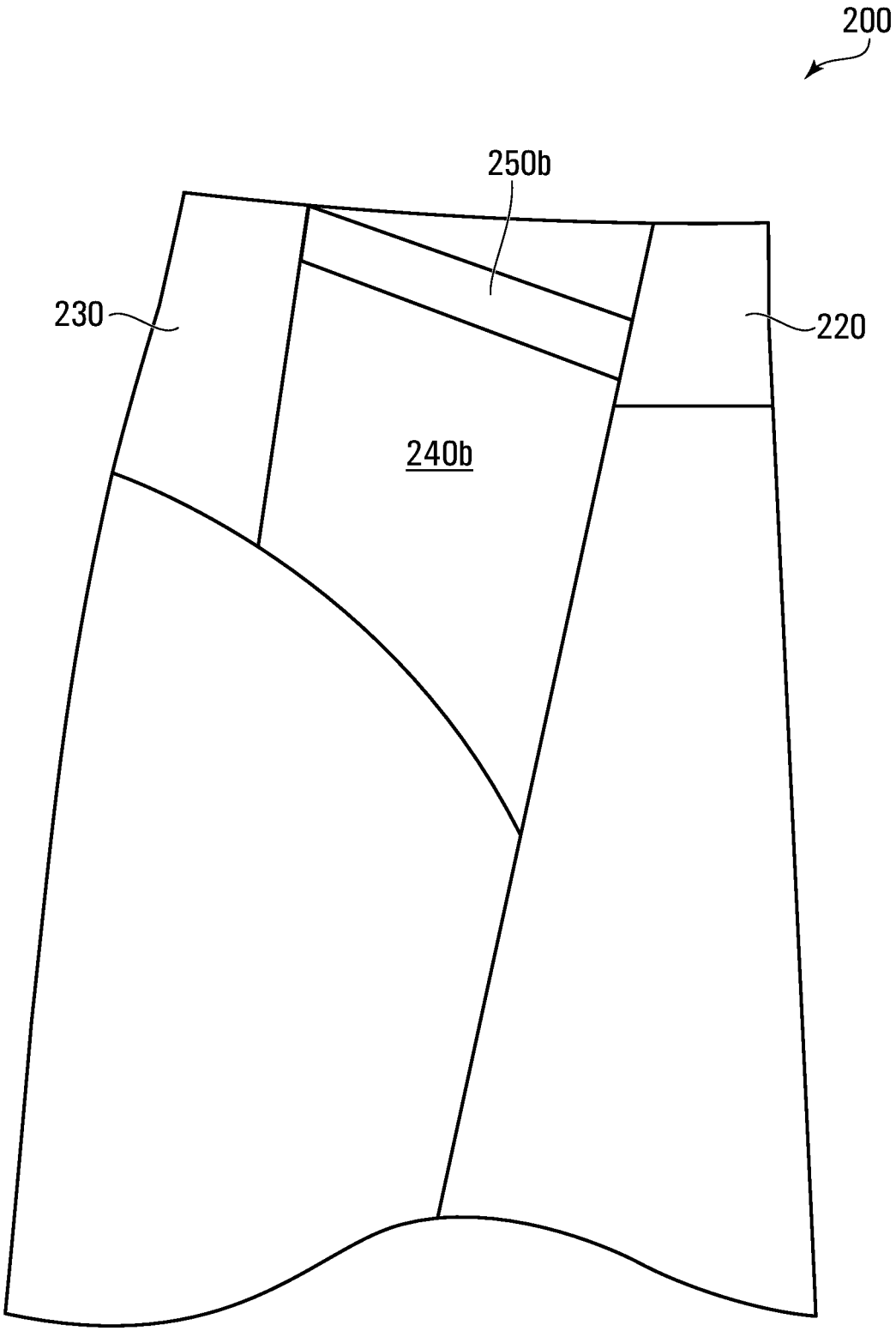
FIG. 7 is a left side view of the skirt.
Figure 8:
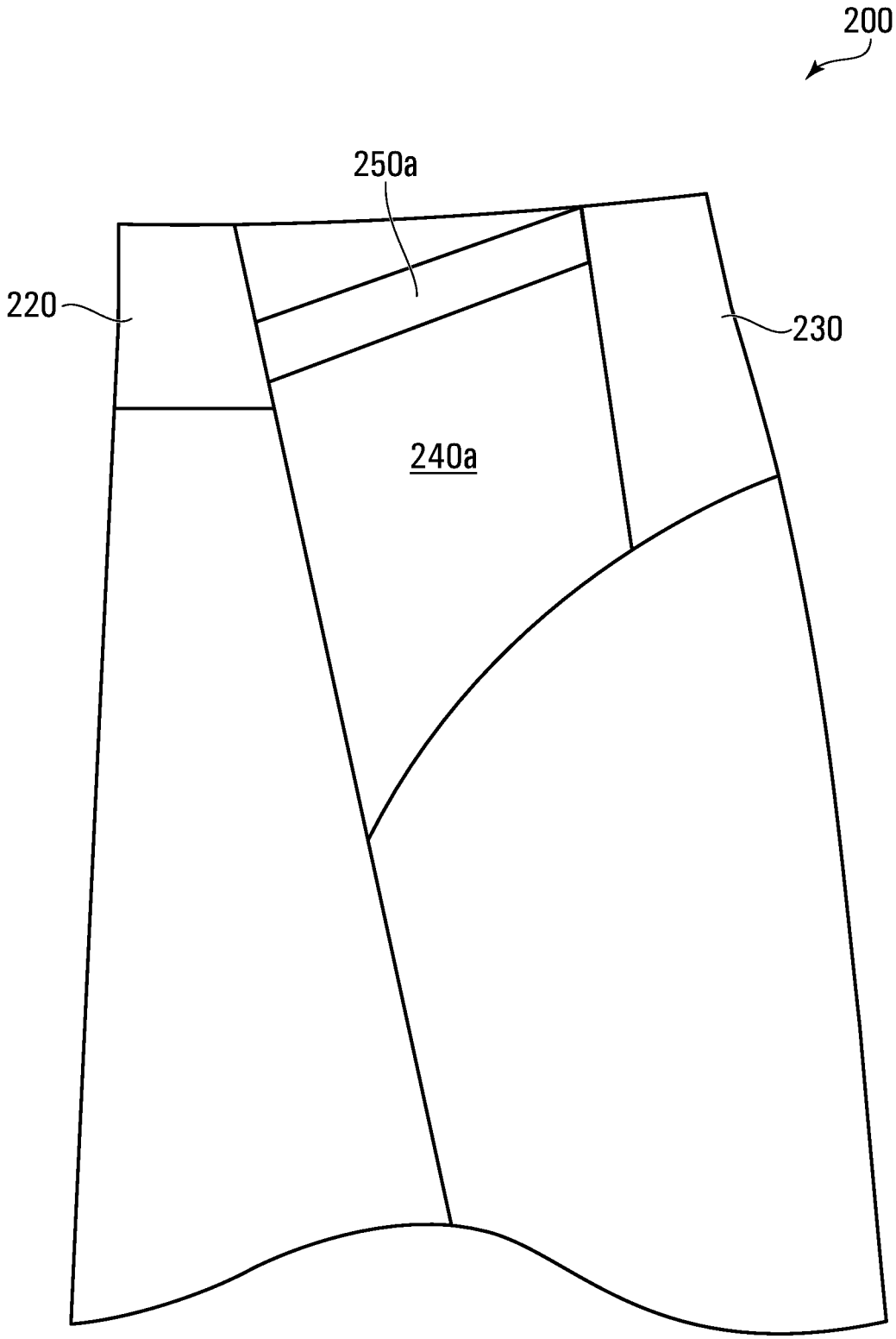
FIG. 8 is a right side view of the skirt.
Figure 9:
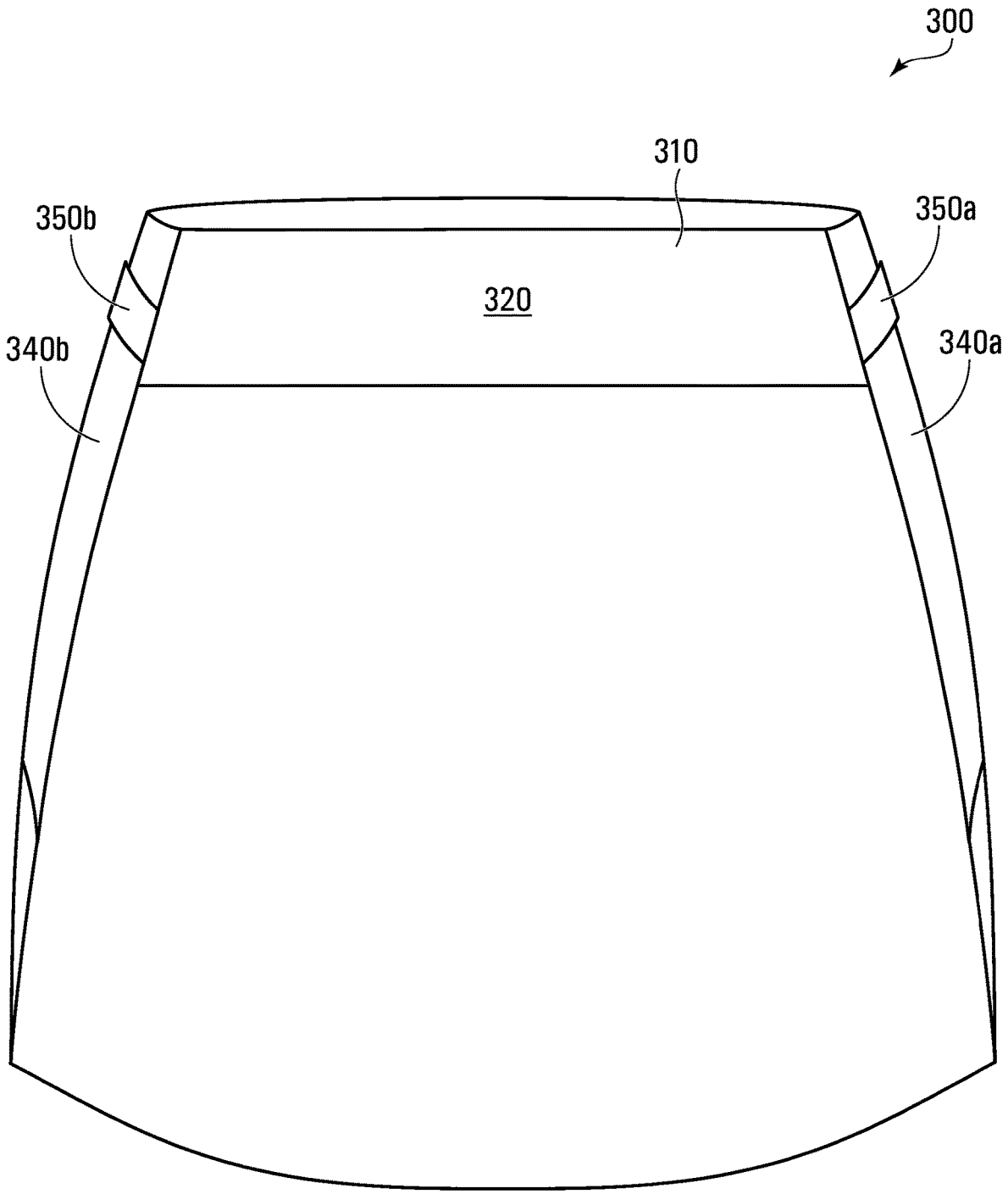
FIG. 9 shows a front view of a skort having a waistband.
Figure 10:
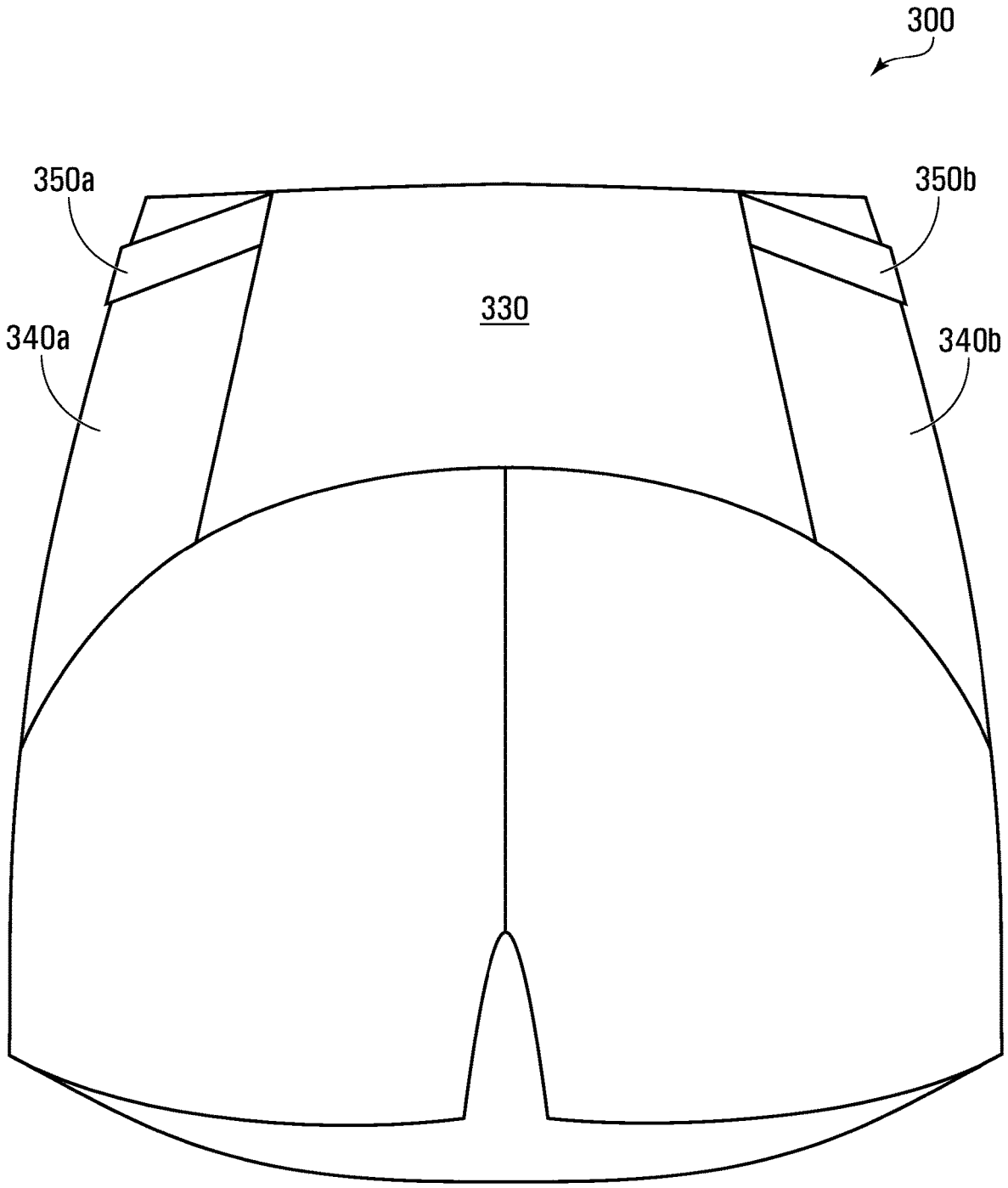
FIG. 10 is a rear side view of the skort.
Figure 11:
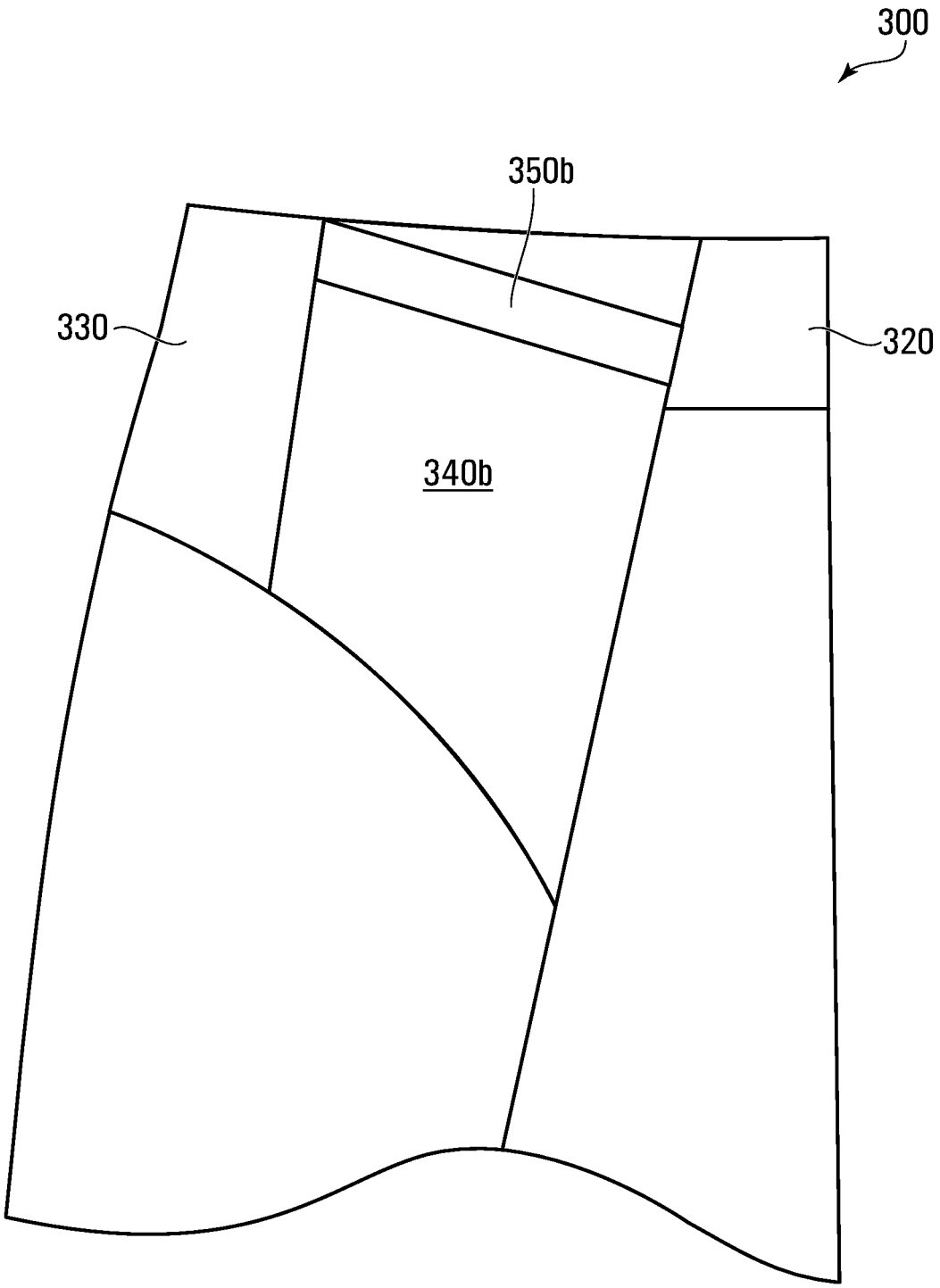
FIG. 11 is a left side view of the skort.
Figure 12:
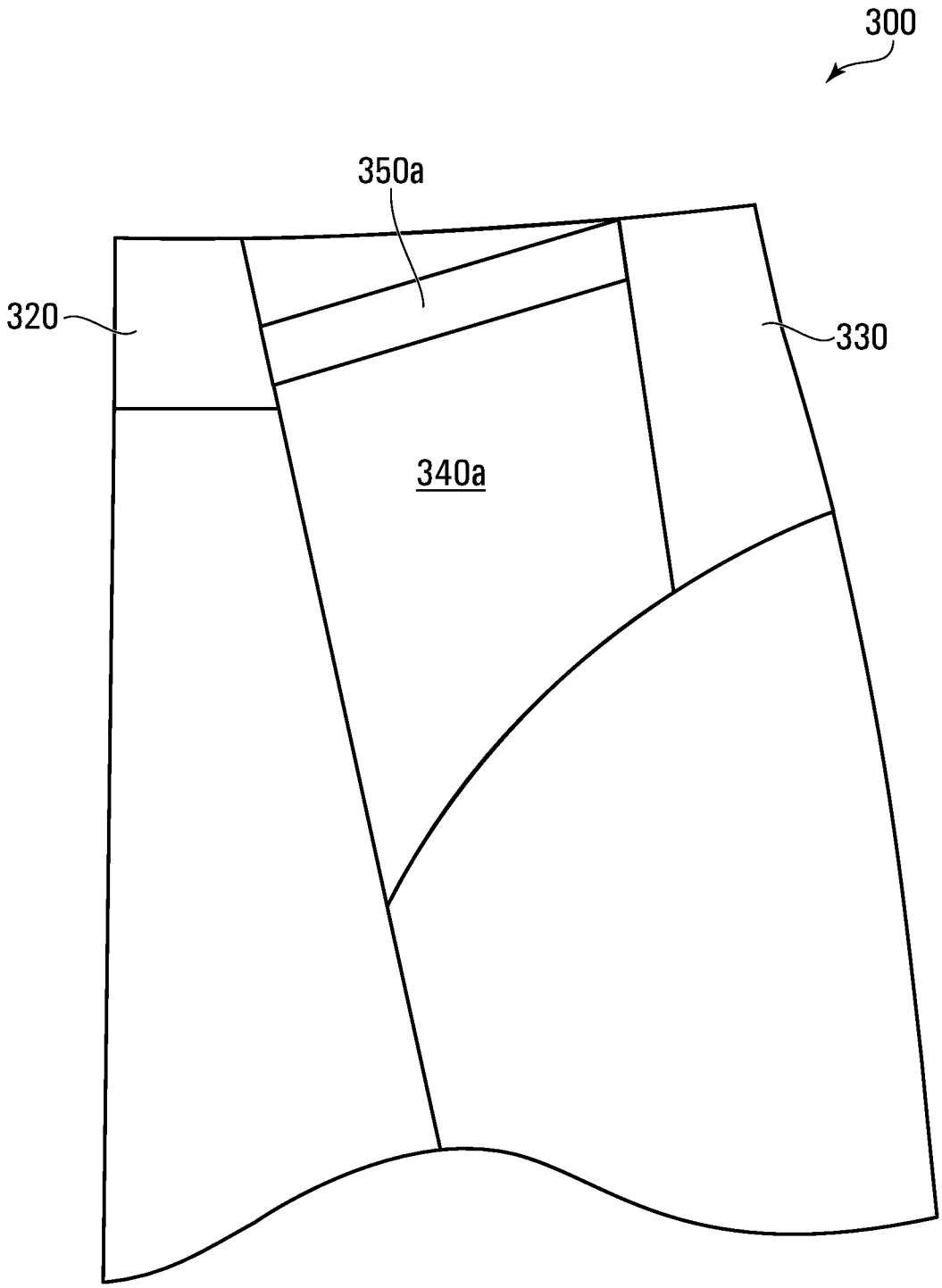
FIG. 12 is a right side view of the skort.
Figure 13:
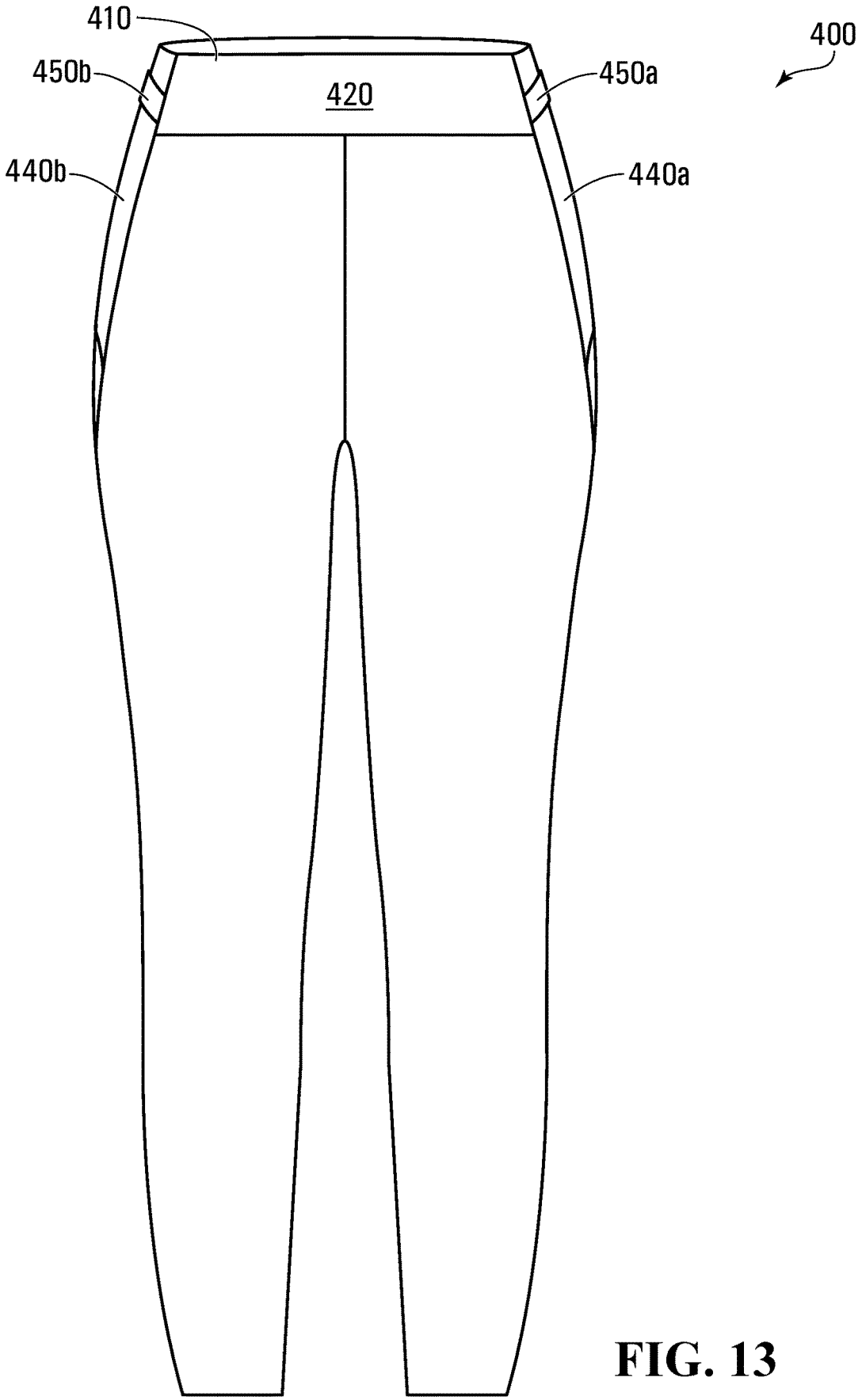
FIG. 13 shows a front view of a pair of pants having a waistband.
Figure 14:
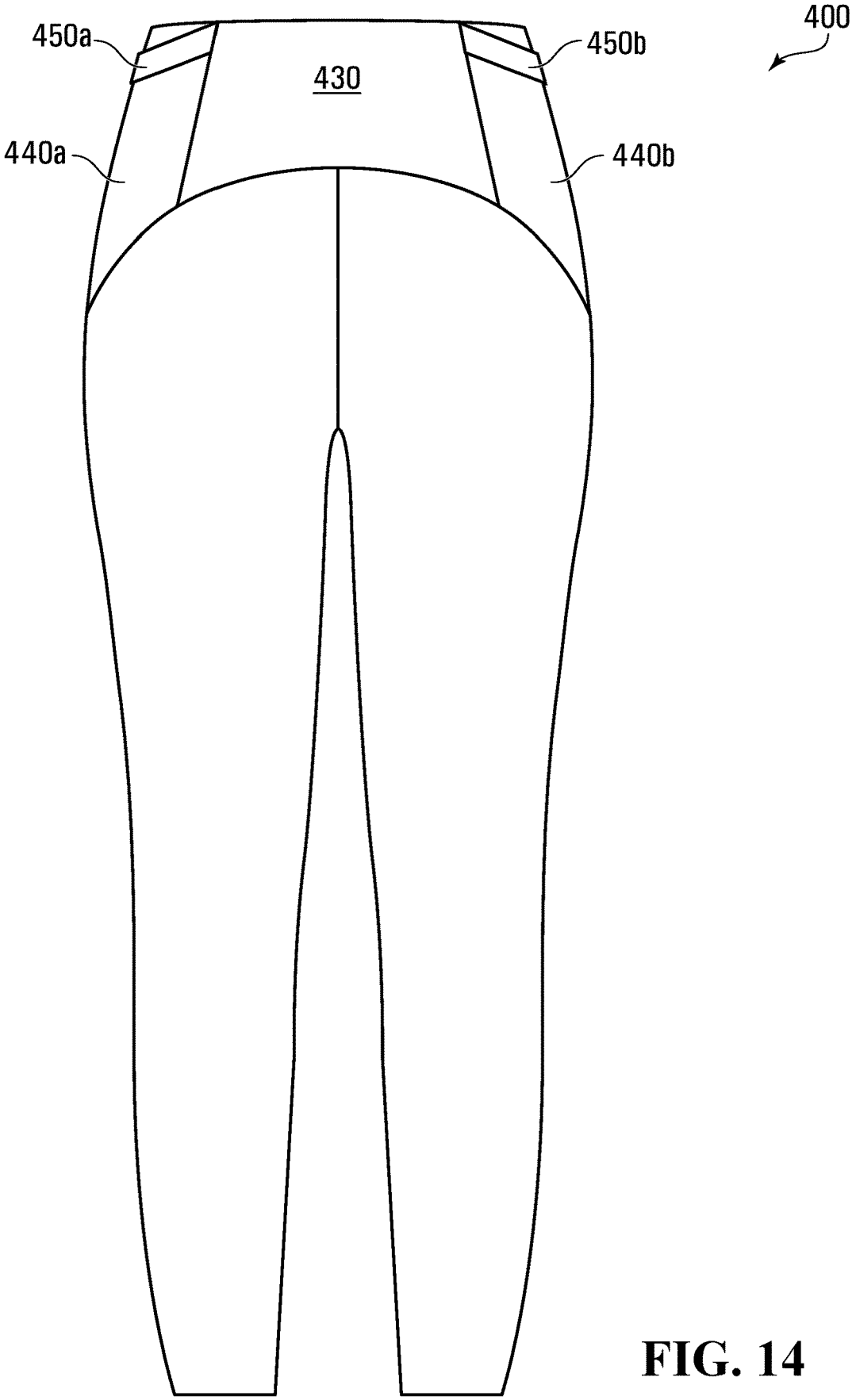
FIG. 14 is a rear side view of the pants.
Figure 15:
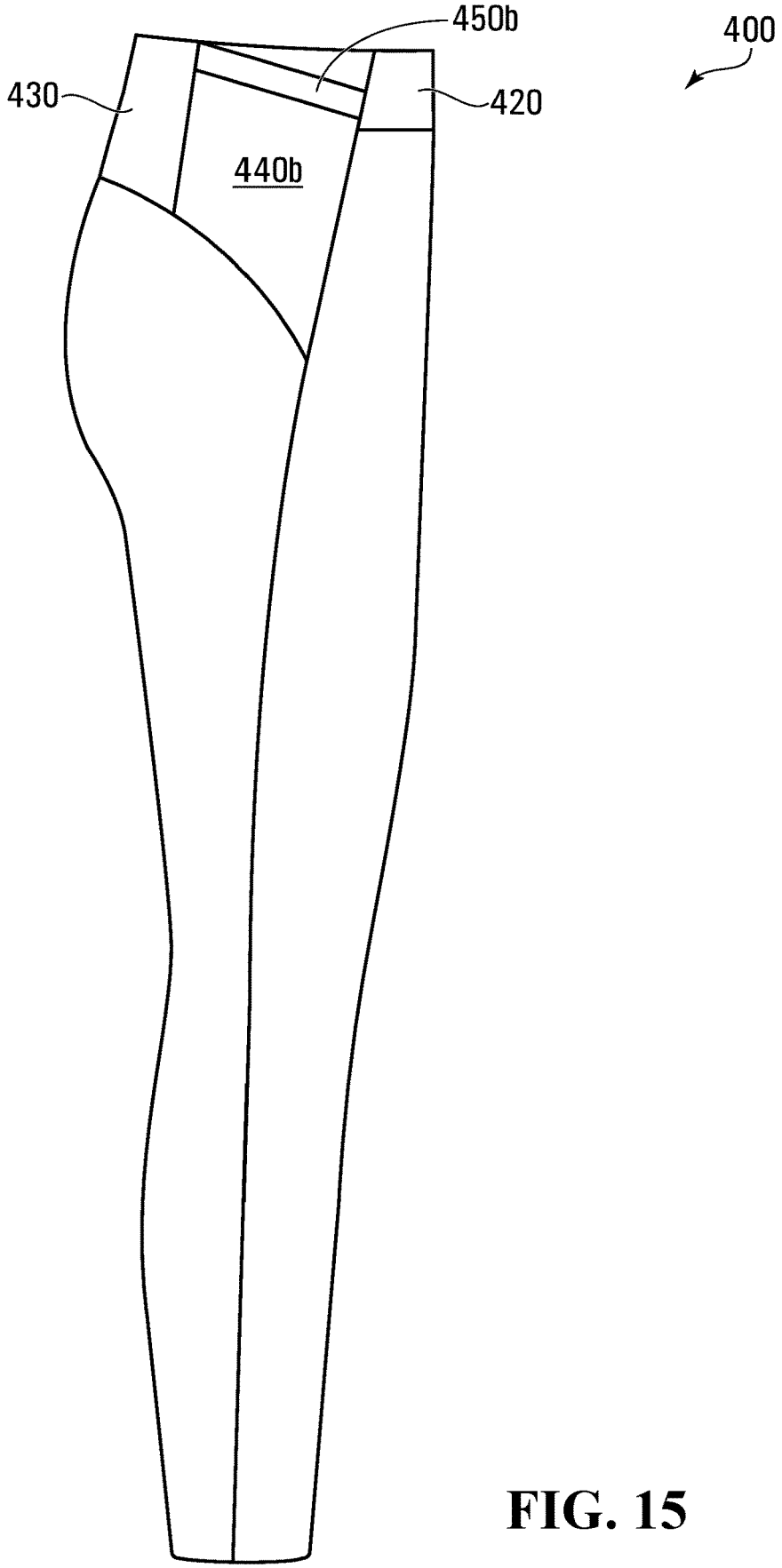
FIG. 15 is a left side view of the pants.
Figure 16:
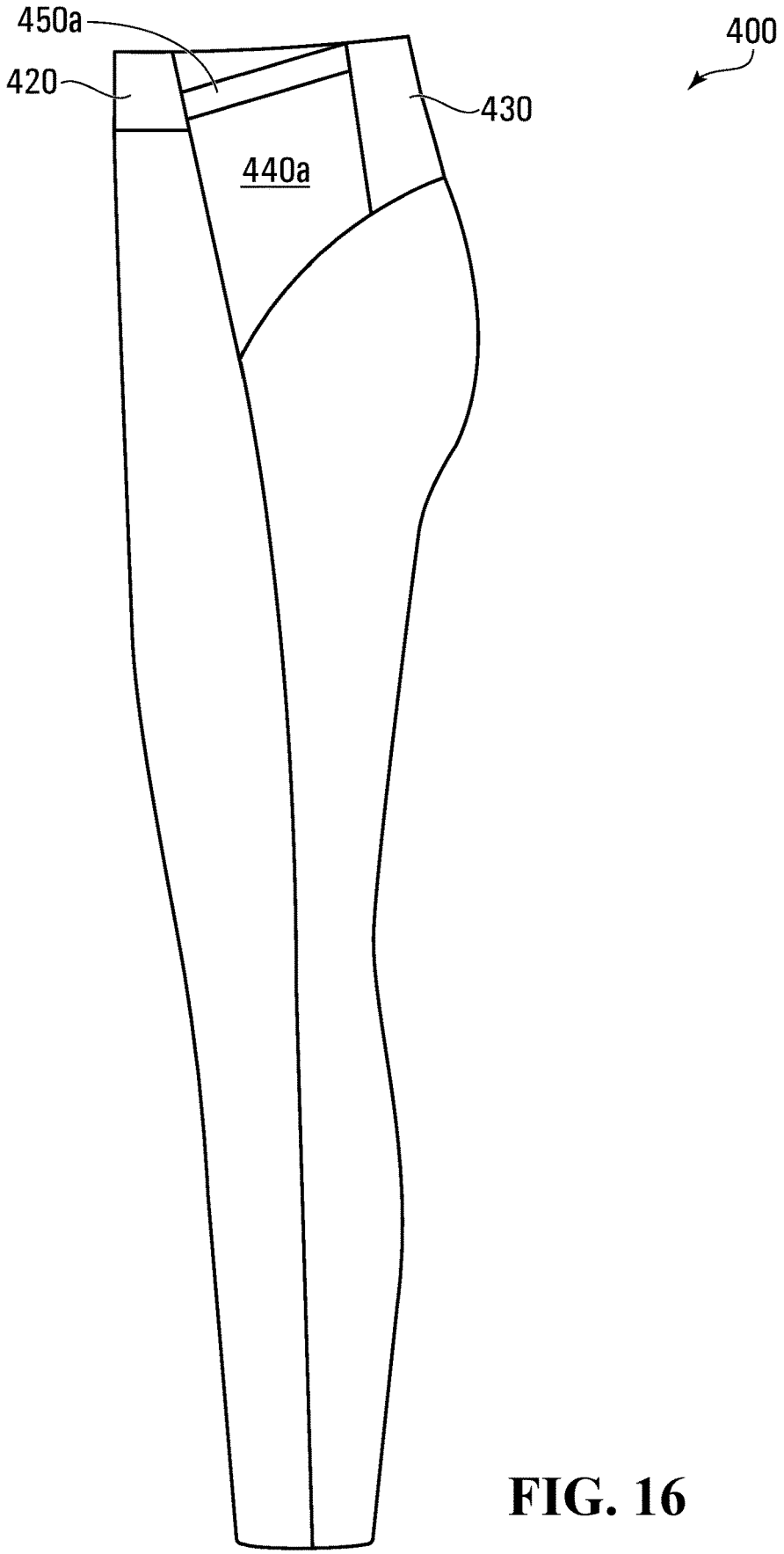
FIG. 16 is a right side view of the pants.

Turning to FIGS. 5-8, an exemplary skirt 200 is provided having a waistband 210, front panel 220, back panel 230, left and right side panels 240*a*, 240*b*, and accessory straps 250*a*, 250*b*. Turning to FIGS. 9-12, an exemplary skort 300 is provided having a waistband 310, front panel 320, back panel 330, left and right side panels 340*a*, 340*b*, and accessory straps 350*a*, 350*b*. Turning to FIGS. 13-16, an exemplary pants 400 is provided having a waistband 410, front panel 420, back panel 430, left and right side panels 440*a*, 440*b*, and accessory straps 450*a*, 450*b*.

In some embodiments, the garments described herein are bottom wears. In some embodiments, the waistband described herein is for a bottom wear for covering a lower portion of the wearer's body. In some embodiments, the waistband described herein is for a garment such as shorts, pants, trousers, leggings, skirt, skort, dress, swimsuit, bodysuit, romper, or jumpsuit. In some embodiments, a garment is provided having the waistband described herein. Exemplary garments include, but are not limited to, shorts, pants, trousers, leggings, skirt, skort, dress, swimsuit, bodysuit, romper, or jumpsuit.

In some embodiments, the garment has a lining behind all of the panels. In one embodiment, the garment is a skirt with a undershort lining behind the panels. In some embodiments, the lining is made of Luxtreme, nylon , Lycra™, a nylon/Lycra™ blend, a knit fabric, a sweat wicking fabric, a four-way stretch fabric, and/or a breathable fabric.

In some embodiments, the waistband comprises one or more additional structural layers, trims, or the like in or attached to one or more of the waistband panels. In some embodiments, the waistband includes a flex rubber elastic trim around all or a portion of the circumference of the waistband. In some embodiments, a flex rubber elastic trim is stitched along the inside top edge of the waistband. In some embodiments the flex rubber elastic is 100% rubber and in some embodiments the flex rubber elastic is a synthetic, natural, specialized or composite of rubber.

Although the embodiments have been described in detail, it should be understood that various changes, substitutions and alterations can be made herein. Moreover, the scope of the present application is not intended to be limited to the particular embodiments or examples described in the specification. As can be understood, the examples described above and illustrated are intended to be exemplary only.

For example, the present invention contemplates that any of the features shown in any of the embodiments described herein, may be incorporated with any of the features shown in any of the other embodiments described herein, and still fall within the scope of the present invention.

What is claimed is:

1. A waistband for a garment, comprising:

a front panel configured when worn on a body to cover a portion of the body proximate to the front and waistline, the front panel having an upper edge defining a front upper edge of the garment, a lower edge attached to at least one front lower torso panel configured to cover a front portion of a lower torso and a front portion of at least one leg when worn on the body, and two side edges, the front panel having a vertical top to bottom length extending between the upper edge and the lower edge of the front panel and being free of seams between the respective upper and lower edges of the front panel, wherein the vertical top to bottom length of the front panel is uniform;

a back panel configured when worn on a body to cover a portion of the body proximate to the back and waistline, the back panel having an upper edge defining a back upper edge of the garment, a lower edge attached to at least one back lower torso panel configured to cover a back portion of a lower torso and a back portion of at least one leg when worn on the body, and two side edges, the back panel having a vertical top to bottom length extending between the upper edge and the lower edge of the back panel and being free of seams between the respective upper and lower edges of the back panel, wherein the vertical top to bottom length of the back panel is greater than the vertical top to bottom length of the front panel;

two side panels, each of the two side panels configured to connect the front panel and the back panel, the each of the two side panels having an upper edge defining a side upper edge of the garment, a lower edge attached to the back lower torso panel, and two side edges and being free of seams between the respective upper and lower edges, wherein a first side edge of each of the two side panels proximate to the front panel has greater vertical top to bottom length than a vertical top to bottom length of a second side edge of the each of the two side panels proximate to the back panel, and the vertical top to bottom length of the first side edge of each of the two side panels is greater than the vertical top to bottom length of the front panel;

wherein the each of the two side panels provide an amount of compression greater than the compression of the front panel or back panel.

2. The waistband of claim 1, wherein the front panel, back panel, and two side panels comprise one or more fabric layers.

3. The waistband of claim 1, wherein the vertical top to bottom length of the front panel is less than 70% of the vertical top to bottom length of the back panel.

4. The waistband of claim 1, wherein one or more of the two side panels are constructed of a thicker fabric exhibits greater elastic recovery than the front panel or back panel fabric.

5. The waistband of claim 1, wherein one or more of the two side panels are constructed of a different fabric than the front panel or back panel.

6. The waistband of claim 1, wherein the two side panels are constructed of one or more same fabric.

7. The waistband of claim 1 wherein the front panel and back panel are constructed of one or more same fabric.

8. The waistband of claim 1 further comprising an elasticized accessory strap having a top edge and a bottom edge and attached to a side panel.

9. The waistband of claim 8 wherein the elasticized accessory strap is attached to the side panel such that the bottom edge of the elasticized accessory strap is offset from the bottom edge of the front panel.

10. The waistband of claim 1 wherein the back panel lower edge forms a substantially concave line.

11. The waistband of claim 10 wherein the lower edge of one or more of the two side panels aligns with the substantially concave back panel lower edge to form an extended substantially concave line.

12. The waistband of claim 1 wherein one or more of the two side panels further comprises one or more of a fabric coating, an applied compression fabric, an applied compression mesh, an adhesive applied on a fabric surface, or an adhesive applied between one or more fabric layer.

13. The waistband of claim 1, wherein the garment is one of a short, pant, trouser, legging, skirt, skort, dress, swimsuit, bodysuit, romper, or jumpsuit.

14. A garment having the waistband according to claim 1, wherein the garment is a short, pant, trouser, legging, skirt, or skort.

15. The waistband of claim 1, wherein each of the side panels comprises an engineered support structure comprising a pattern of a plurality of adhesive dots.

16. The waistband of claim 15, wherein the engineered support structure comprises at least one first zone with a first level of support defined by a first adhesive dots density or a first size of the adhesive dots and at least one second zone with a second level of support defined by a second adhesive dots density or a second size of the adhesive dots.

17. The waistband of claim 1, wherein the second side edge of each of the two side panels terminates at the lower edge of the back panel.

18. A waistband for a bottom wear, comprising:

a front panel configured when worn on a body to cover a portion of the body proximate to the front and waistline, the front panel having an upper edge defining a front upper edge of the waistband, a lower edge attached to at least one front lower torso panel configured to cover a front portion of a lower torso and a front portion of at least one leg when worn on the body, and first and second side edges, and being free of seams between the respective upper and lower edges of the front panel;

a back panel configured when worn on a body to cover a portion of the body proximate to the back and waistline, the back panel having an upper edge defining a back upper edge of the waistband, a lower edge attached to at least one back lower torso panel configured to cover a back portion of a lower torso and a back portion of at least one leg when worn on the body, and first and second side edges and being free of seams between the respective upper and lower edges of the back panel;

a first side panel configured to connect to the first side edge of the front panel and the first side edge of the back panel, and a second side panel configured to connect to the second side edge of the front panel and the second side edge of the back panel, thereby defining a circumference of the waistband, the first and second side panels individually being free of seams between the respective upper and lower edges and providing an amount of compression greater than the compression of the front panel or the back panel, wherein a respective first side edge of the first and second side panels is connected to the first side edge and the second side edge of the front panel and a respective second side edge of the first and second side panels is connected to the first side edge and the second side edge of the back panel;

wherein the first side edges of the first side panel and the second side panel each have a greater vertical top to bottom length than a vertical top to bottom length of the second side edges of the first and second side panels, the vertical top to bottom length of the first side edge of the each of the two side panels is greater than the vertical top to bottom length of the front panel, and the second side edges of the first side panel and the second side panel each terminate at the lower edge of the back panel.

19. A bottom wear having the waistband according to claim 18, wherein the bottom wear is a short, pant, trouser, legging, skirt, or skort.

20. The waistband of claim 18, wherein the first side panel and the second side panel are each free of seams between the respective upper and lower edges.

21. A waistband for a garment, comprising:

a front panel configured when worn on a body to cover a portion of the body proximate to the front and waistline, the front panel having an upper edge defining a front upper edge of the garment, a lower edge attached to at least one front lower torso panel configured to cover a front portion of a lower torso and a front portion of at least one leg when worn on the body, and two side edges, the front panel having a vertical top to bottom length extending between the upper edge and the lower edge of the front panel;

a back panel configured when worn on a body to cover a portion of the body proximate to the back and waistline, the back panel having an upper edge defining a back upper edge of the garment, a lower edge attached to at least one back lower torso panel configured to cover a back portion of a lower torso and a back portion of at least one leg when worn on the body, and two side edges, the back panel having a vertical top to bottom length extending between the upper edge and the lower edge of the back panel, wherein the vertical top to bottom length of the back panel is greater than the vertical top to bottom length of the front panel;

two side panels, each of the two side panels configured to connect the front panel and the back panel, the each of the two side panels having an upper edge defining a side upper edge of the garment, a lower edge attached to the back lower torso panel, and two side edges, and being free of seams between the respective upper and lower edges, wherein a first side edge of the each of the two side panels proximate to the front panel has greater vertical top to bottom length than a vertical top to bottom length of a second side edge of the each of the two side panels proximate to the back panel, and the vertical top to bottom length of the first side edge of the each of the two side panels is greater than the vertical top to bottom length of the front panel and is greater than the vertical top to bottom length of the back panel.

22. The waistband of claim 21, wherein the back panel lower edge forms a substantially concave line.

23. The waistband of claim 21, wherein the second side edges of the first side panel and the second side panel each terminate at the lower edge of the back panel.

24. A garment having the waistband according to claim 21, wherein the garment is a short, pant, trouser, legging, skirt, or skort.

* * * * *